US005195444A

United States Patent [19]

Daniels

[11] Patent Number: 5,195,444

[45] Date of Patent: Mar. 23, 1993

[54] SAILBOARD

[76] Inventor: John J. Daniels, 350 Bristol St., Unit A-1, Waterbury, Conn. 06708

[21] Appl. No.: 751,797

[22] Filed: Aug. 29, 1991

[51] Int. Cl.[5] ..... B63B 35/79

[52] U.S. Cl. ..... 114/39.2; 114/280; 441/74; 441/79

[58] Field of Search ..... 114/39.2, 274, 280; 441/74, 79

[56] References Cited

U.S. PATENT DOCUMENTS

| | | | |
|---|---|---|---|
| 3,747,138 | 7/1973 | Morgan | 441/79 |
| 3,902,207 | 9/1975 | Tinkler et al. | 441/74 |
| 3,988,794 | 11/1976 | Tinkler et al. | 441/74 |
| 4,441,446 | 4/1984 | Fichtner | 114/39.2 |
| 4,508,046 | 4/1985 | Coulter et al. | 441/74 |
| 4,649,847 | 3/1987 | Tinkler et al. | 441/74 |
| 4,715,304 | 12/1987 | Steinberg | 114/274 |
| 4,963,111 | 10/1990 | Moulin | 441/79 |

FOREIGN PATENT DOCUMENTS

| | | | |
|---|---|---|---|
| 337904 | 10/1989 | European Pat. Off. | 441/79 |
| 2834291 | 2/1980 | Fed. Rep. of Germany | 441/79 |
| 3130554 | 3/1983 | Fed. Rep. of Germany | 114/274 |
| 3610887 | 10/1987 | Fed. Rep. of Germany | 441/74 |
| 7811316 | 5/1979 | Netherlands | 441/74 |

*Primary Examiner*—Sherman Basinger
*Assistant Examiner*—Thomas J. Brahan
*Attorney, Agent, or Firm*—John J. Daniels

[57] ABSTRACT

The present invention relates to an apparatus designed to launch a sailboard out of the water while the sailboard is being sailed on the water. The apparatus comprises launching means including a flap which is submergible in the water and pivotally supported at one end of the flap near the bottom of the sailboard. An angle of attack of the flap relative to the water is varied by a positioning means. The submerged flap is thus presented at an oblique angle to the incompressible water which thus acts as a ramp to launch the sailboard out of the water. In an alternative embodiment, a hydrofoil wing acts to lift the sailboard relative to the water surface.

18 Claims, 8 Drawing Sheets

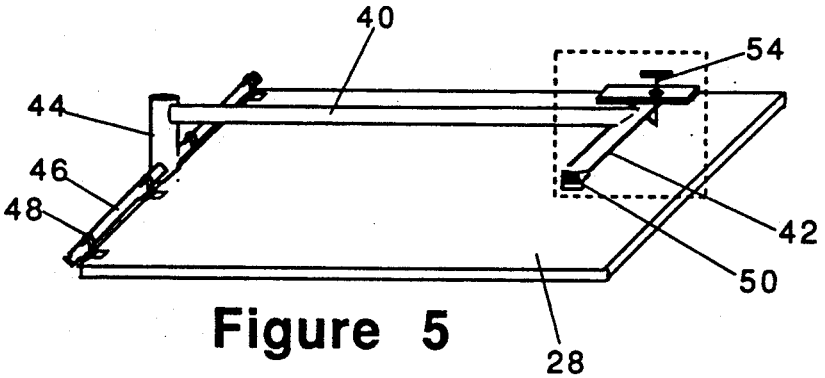
Figure 5
Figure 7(a)
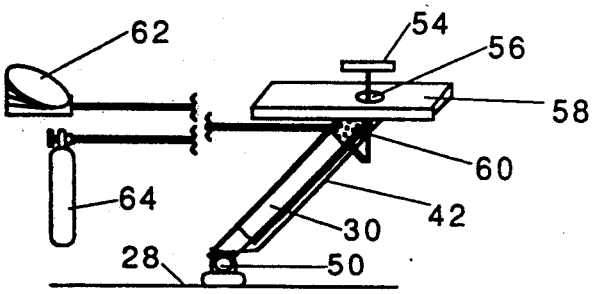
Figure 6(a)
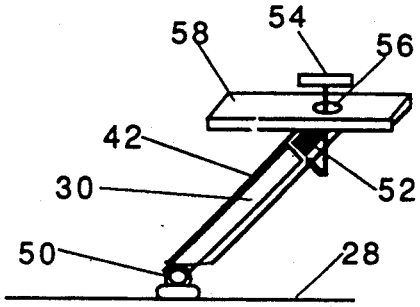
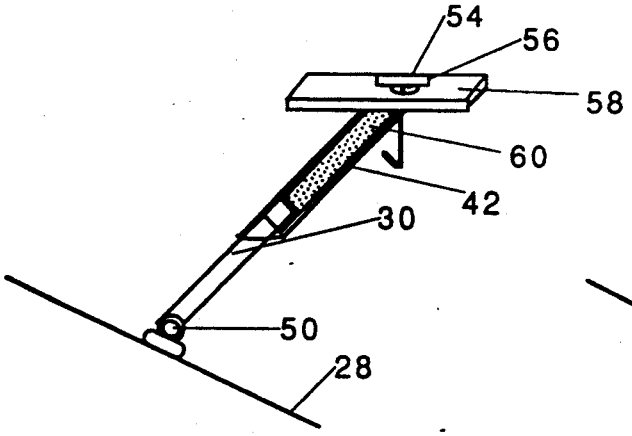
Figure 7(b)
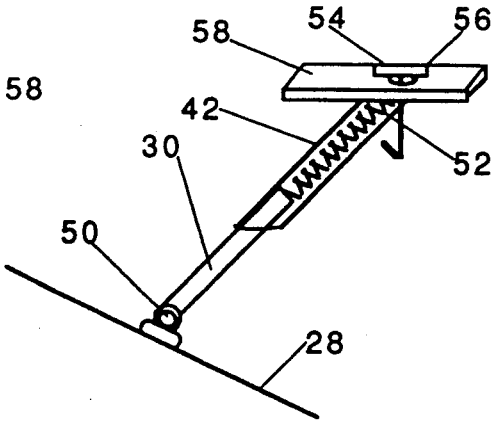
Figure 6(b)

SAILBOARD

BACKGROUND OF THE INVENTION

The present invention relates to an improvement in sailboards. In particular, the present invention relates to an apparatus designed to launch a sailboard out of a body of water while the sailboard is being sailed on the water.

A sailboard is a small sailing craft having a hull much like a surfboard. An example of a sailboard is shown in FIG. 3. A mast 12 is attached to the sailboard hull 14 through a pivotable and rotatable connecting member, known as a universal joint 16. The universal joint 16 may be secured to the sailboard hull 14 by a peg member which is integral with the universal joint 16 and is inserted into a mast hole 18 located towards the bow of the sailboard hull 14. A wish-bone boom 20 is attached to the mast 12. A triangular sail 22 is attached to the mast 12 along the sail's long edge and is also attached to the wish-bone boom 20 at a point of the sail 22. Usually, the sailboard hull 14 will have a fin 24 and may sometimes have a center-board 26.

The sailboard is sailed across the water surface S mainly through the action of wind being caught in the sail 22. A surfer 26 stands on the top of the sailboard hull 14 and holds onto the wish-bone boom 20. The force of the wind is transferred to the sailboard hull 14 through the mast 12 and through the body of the surfer 26. The direction travelled by the sailboard can be controlled by the surfer 26 by manipulating the angle of the sail 22 relative to the wind.

It is common for a surfer to sail his sailboard at a cresting wave. The protrusion of the wave and the slope of the wave face creates a fluid ramp from which the sailboard may be launched out of the water, which the surfer may find to be exhilarating. This launching out of the water is commonly termed "wave-hopping". However, in order to be launched out of the water, sailboards conventionally required that a wave exist. Thus, wave-hopping has been limited to bodies of water in which suitable waves are present and sailboarding on relatively flat water lacks the wave-hopping exhilaration. Also, even when waves do exist, they are often inadequate to launch the sailboard being sailed in a given wind.

SUMMARY OF THE INVENTION

The present invention is intended to overcome the above mentioned drawbacks. An object of the present invention is to provide an apparatus for launching a sailboard even when there are little or no waves present.

To accomplish this, the present invention provides for an apparatus which is operable for launching a sailboard when the sailboard is being sailed on a body of water. The invention comprises launching means, including a flap which is submergible in the water and pivotally supported at one end of the flap near the bottom of the sailboard. The flap has an angle of attack relative to the water. The angle of attack is varied by a positioning means. In an initial position of the flap, it is substantially parallel with the sailboard and the water surface. When a surfer intends to launch her sailboard, she uses the positioning means to alter the angle of attack of the flap. The submerged flap is thus presented to the water at a different angle of attack. The incompressible water thus acts as a ramp and the sailboard is launched out of the water.

BRIEF DESCRIPTION OF THE DRAWINGS

FIG. 1(*b*) is a perspective representation of the inventive device being launched from the water;

FIG. 2(*b*) is a plan view of the inventive device showing the transfer of force when the angle of attack of the flap is varied;

FIG. 4(*b*) is an isolated perspective view of a first embodiment of the flap and the positioning means with the flap at an altered angle of attack position;

FIG. 5 is an isolated perspective view of other embodiments of the flap and the positioning means;

FIG. 6(*a*) is an isolated perspective view of another embodiment showing the positioning means in an initial angle of attack position;

FIG. 6(*b*) is an isolated perspective view of the FIG. 6(*a*) embodiment showing the positioning means in an altered angle of attack position;

FIG. 7(*a*) is an isolated perspective view of yet another embodiment showing the positioning means in an initial angle of attack position;

FIG. 7(*b*) is an isolated perspective view of the FIG. 7(*a*) embodiment showing the positioning means in an altered angle of attack position;

FIG. 8(*b*) is an isolated plan view of the FIG. 8(*a*) embodiment showing the hydrofoil wing flap at an altered angle of attack position;

FIG. 9(*b*) is a perspective representation of the FIG. 9(*a*) embodiment showing the flap at an altered angle of attack position;

FIG. 10(*b*) is a perspective representation of another embodiment of the structural frame of the inventive device.

DETAILED DESCRIPTION OF THE DRAWINGS

Figure 1A:
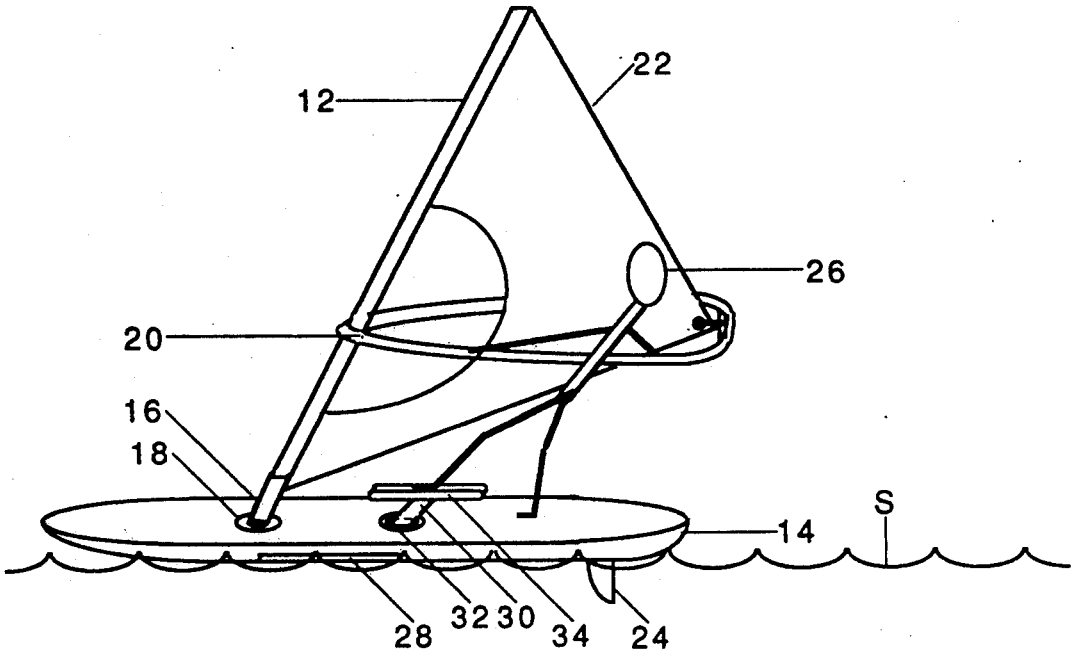
FIG. 1(*a*) is a perspective representation of the inventive device being sailed on the water.
Figure 1B:
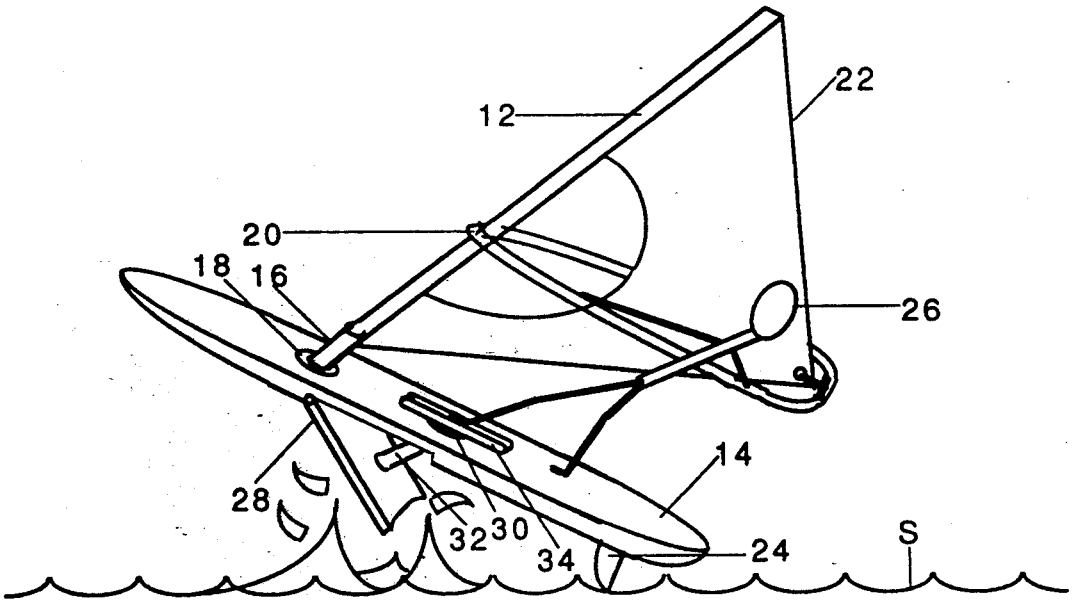

Referring to FIG. 1(*a*), the invention may be comprised of launching means including a flap 28, a stem 30 and a footboard 34. The flap 28 is pivotally mounted at one end towards the bottom of the sailboard hull 14. As shown in FIG. 1(*a*) the angle of attack of the flap 28 relative to the water is such that the flap 28 adds little to the resistance of the sailboard hull 14 when the flap 28 is in its initial position. In the initial position, the stem 30 passes through a stem hole 32 such that the footboard 34 is in a raised position. As the surfer 26 directs the direction of the sailboard by manipulating the angle of the sail 22 relative to the wind, he may place his leading foot upon the footboard 34 so that he is ready to exert a force on the footboard 34.

As shown in FIG. 1(*b*), when the surfer 26 applies a force with his leg to the footboard 34, the stem 30 is passed through the stem hole 32 and forces the flap 28 to alter its angle of attack relative to the water as the flap 28 pivots. Thus creating an oblique angle of attack of the flap 28 which causes the sailboard and surfer 26 to be launched from the water.

Figure 2A:
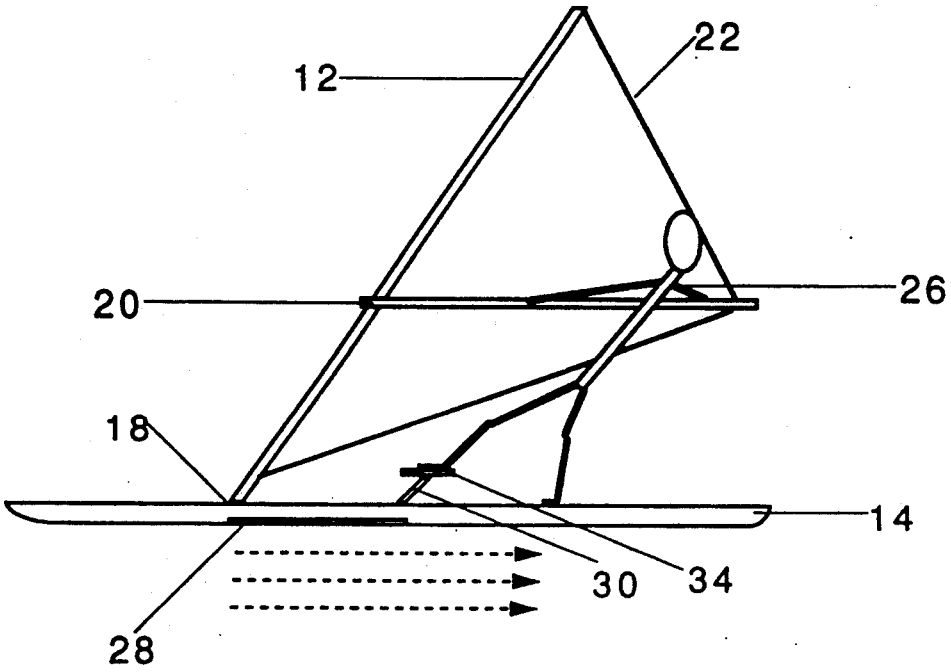
FIG. 2(*a*) is a plan view of the inventive device being sailed on the water.
Figure 2B:
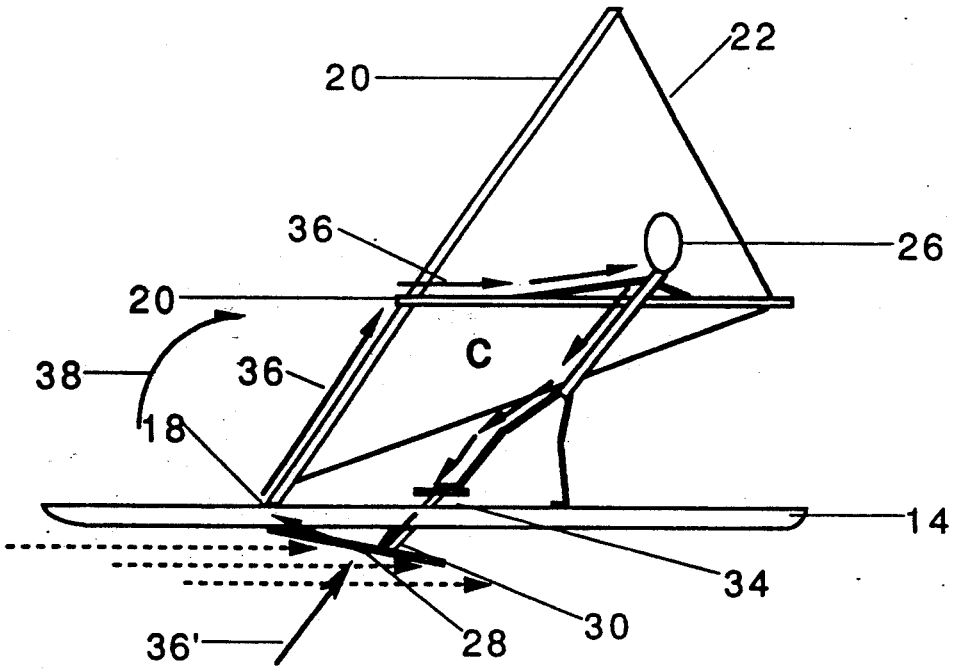

FIG. 2(*a*) is a plan view showing the initial position of the surfer 26 just prior to applying a force to the footboard 34. The dashed arrows represent the flow of water relative to the sailboard hull (actually, the water is stationary with the sailboard hull 14 moving relative to the water). The flow of water relative to the sailboard hull 14 is at this time substantially parallel to the bottom of the sailboard hull 14 and the flap 28 is in the initial parallel position.

FIG. 2(*b*) is a plan view of the device as the surfer 26 applies a force to the footboard 34. The force applied by the surfer 26 to the footboard 34 is transferred through the stem 30 to the flap 28 causing it to pivot about its pivot point which is the flap's 28 pivotable attachment to the sailboard hull 14. The flap 28 thus presents an altered or oblique angle of attack relative to the water. The flow of water represented by the dashed lines is shown to come in contact with the flap 28 which is moving through the water. The force 36' results from the incompressible nature of the flow of water coming in contact with the oblique angle of attack of the flap 28. The speed and momentum of the sailboard and surfer 26 system result in a ramping effect being created by the flap 28 and the incompressible water. The lines of force transfer 36 show that the force 36' is substantially transferred through the flap 28 to the mast 12 to the wishbone boom 20 to the surfer 26, down to the footboard 34 through the stem 30 and finally back to the flap 28. This creates a rotation shown by curved line 38 about a center of rotation C causing the bow of the sailboard hull 14 to be lifted up. Thus, the sailboard and surfer 26 may be launched from the water. This launching from the water can occur even if the surface of the water S that the surfer 26 is sailing on is relatively flat. Therefore, the surfer 26 may experience the exhilarating sensation of being launched from the water, even when no waves are present. Alternatively, by timing the application of the force by the surfer 26 to the footboard 34 as the sailboard hull 14 approaches the crest of a wave, the launching effect of the wave can be amplified.

Figure 4A:
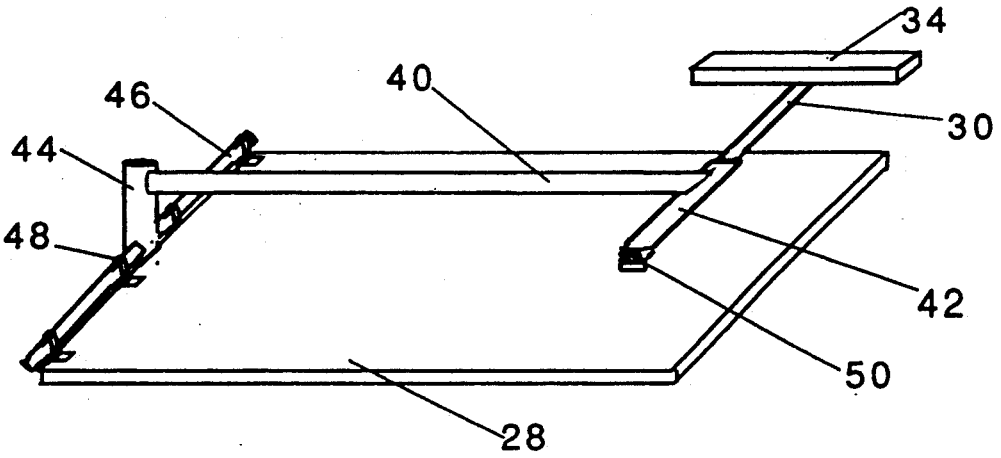
FIG. 4(*a*) is an isolated perspective view of a first embodiment of the flap and the positioning means with the flap at an initial angle of attack position.
Figure 4B:
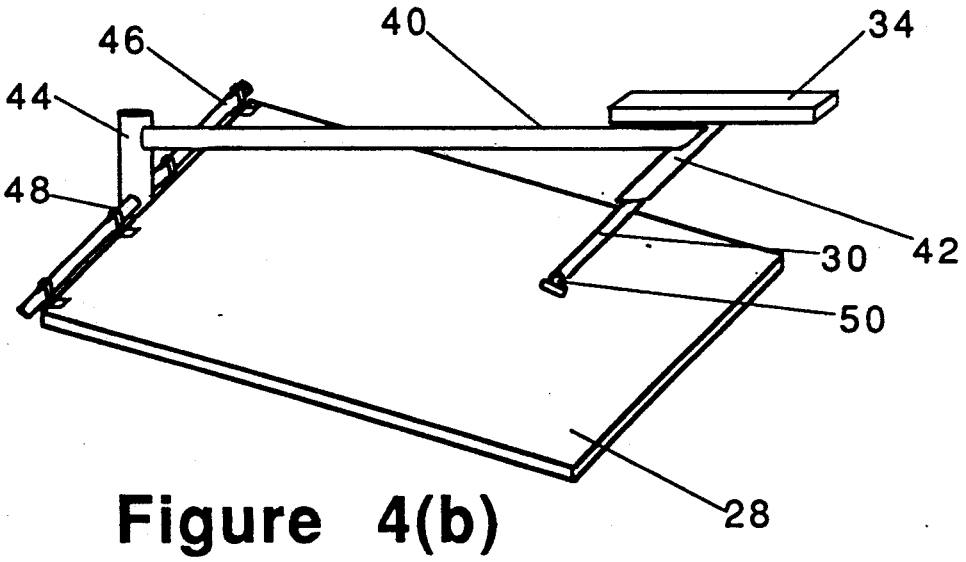

FIG. 4(*a*) is an isolated view of the launching means in the initial position. In this embodiment, a support structure 40 is disposed between a mast force transfer member 44 and a stem guide 42 (these elements may be fixed within the sailboard). The stem guide 42 guides the movement of the stem 30 and at times may transfer some force through the support structure 40 to the mast force transfer member 44. The mast force transfer member 44 has a rod 46 on which the flap 28 is pivotally supported by hinges 48. The force exerted on the flap 28 is transferred through the mast force transfer member 44 which is preferably positioned at a point located below the mast hole 18 of the sailboard hull 14. Thus, the force exerted on the flap 28 by the surfer 26 and the incompressible water is transferred through the mast force transfer member 44 to the mast 12. It is also preferable that the pivotable attachment of the flap 28, as by the hinges 48 and the rod 46, is forward of the center of mass of the sailboard and surfer 26 system. In other words, in order for the force exerted on the flap 28 to result in the rotation of the bow of the sailboard hull 14 in a rotation about a desirable center of rotation C (shown in FIG. 2(*b*)) the force 34 should be applied to the sailboard and surfer 26 system forward of its center of mass. However, it is also contemplated that the pivotable attachment may be located anywhere along the bottom of the sailboard hull 14. The stem 30 is preferably pivotally supported by a stem pivot 50 which attaches the stem 30 to the flap 28. Thus, the arc-path travelled by the attachment point of the stem 30 to the flap 28 may be compensated by the stem pivot 50. Also, it may be desirable to make the stem guide 42 pivotable relative to the support structure 40. h As shown, in FIG. 4(*b*), when the footboard 34 is forced down, the stem 30 causes the flap 28 to pivot about the rod 46. In this way, the angle of attach of the flap 28 may be altered.

The above described construction of the launching means including the relative dimensions of the flap 28, the stem 30 and the footboard 40 are intended for illustrative purposes. Further, it may be desirable to provide a plurality of flaps 28. Also, the means for pivotally supporting the flap 28 may be of a different construction such as a pin or flexible member. In addition, it is contemplated that the support structure 40, the stem guide 42 and the mast force transfer member 44 may also be alternatively constructed. Further, it may be desirable to construct the launching means and its attachment to the sailboard hull so that it can be retrofitted on a sailboard. The dimensions and location of attachments of the various elements may be alterable to compensate for a variety of conditions such as wind and water condition and the experience and size of the surfer. For example, it may be desirable to so construct the pivotable attachment of the flap 28 to the sailboard hull 14 so that the location of the pivotal attachment may be changed to thus change, for example, the center of rotation C. It also may be desirable to include means for accommodating a centerboard in the construction of the launching means.

FIG. 5 is a perspective view of the launching means showing an alternative embodiment of the positioning means isolated in the dashed box. Three examples of alternative embodiments will next be described with reference to FIGS. 6(*a*), 6(*b*), 7(*a*), 7(*b*), 8(*a*) and 8(*b*). In these next depictions of the first two alternative embodiments, the footboard 34 for transferring a force supplied by the surfer 26 to the flap 28 is not shown. However, it is also contemplated that the following embodiments may act in conjunction with the footboard 34 to facilitate the application of the force to the flap 28 necessary to alter the flap's 28 angle of attack relative to the water in order to launch the sailboard. In the depiction of the third alternative embodiment, spring force means shown in the previous two embodiments is not shown. However, it is also contemplated that the third embodiment may act in conjunction with a spring means described to facilitate the application of the force to the flap 28.

FIG. 6(*a*) shows an alternative embodiment of the positioning means in which the spring means includes a spring member 52 which stores a force and is prevented from prematurely releasing the force by a trigger 54. This trigger 54 passes through a trigger hole 56 that is suitably located at a section of the top of the sailboard hull 58. The stem 30 terminates at one end in contact with the spring member 52 and at the other end is pivotally supported by the stem pivot 50. FIG. 6(*b*) shows the condition after the trigger 54 has released the spring member 52 and the force contained in the spring member 52 is released to the stem 30 to alter the angle of attack of the flap 28. The construction of the trigger 54 may encompass a variety of conventional embodiments and hence is here schematically represented. The spring member 54 may be re-compressed by the landing of the sailboard, and thus, the launching means may also act as a shock absorber to absorb the concussion of the landing of the sailboard. The launching means may also include manual compression means (not shown) for re-compressing the spring member 54.

FIG. 7(*a*) shows yet another alternative embodiment of the positioning means similar to that described in FIGS. 6(*a*) and 6(*b*) wherein the spring member 54 has been replaced by a compressible gas 60. The compressible gas 60 is contained within a suitable cylinder so as to act as a gas spring in much the same manner as the spring member 52 acts. In addition to being re-compressed by the landing, the compressible gas 60 may be re-compressed through a surfer operable foot pump 62 or a compressed gas cylinder 64. FIG. 7(*b*) shows the condition of altered angle of attack of the flap 28.

Figure 8A:
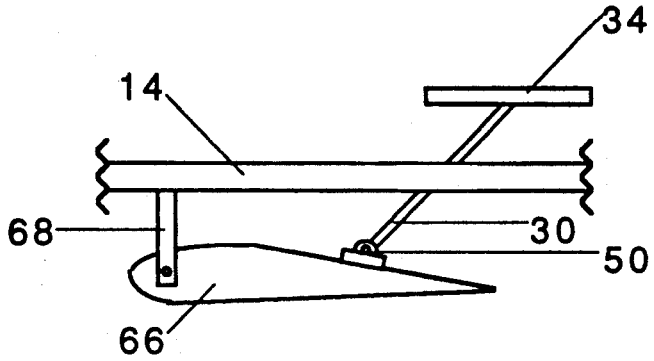
FIG. 8(*a*) is an isolated plan view of still another alternative embodiment showing a hydrofoil wing flap in an initial angle of attack position.
Figure 8B:
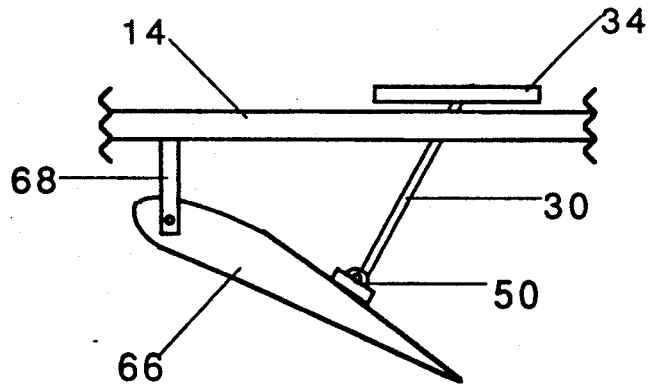

FIG. 8(*a*) shows still another alternative embodiment of the inventive device. In this embodiment, flap 28 has been replaced with a hydrofoil wing 66 which is suspended from the bottom of the sailboard hull 14 by a support post 68. The hydrofoil wing 66 is so formed that it experiences a lifting force as it is moved through the water. This lift is imparted to the sailboard through the support post 68 and the stem 30. This lift may reduce the wetted surface area of the sailboard hull 14 and thus reduce drag. The lifting action may also be exhilarating to the surfer 26. The stem 30 may also include means to lock it in position (not shown) so that it can support the lifting force imparted by the hydrofoil wing 66, and may include a spring means as shown in FIGS. 6 and 7 above. In addition, the support post 68 may be retractable and extendable (not shown) to vary the position of the hydrofoil wing 66 relative to the sailboard hull 14. It is also contemplated that the hydrofoil wing 66 may be fixed to the sailboard hull 14 and act, therefore, only to lift the sailboard from the water.

Figure 3:
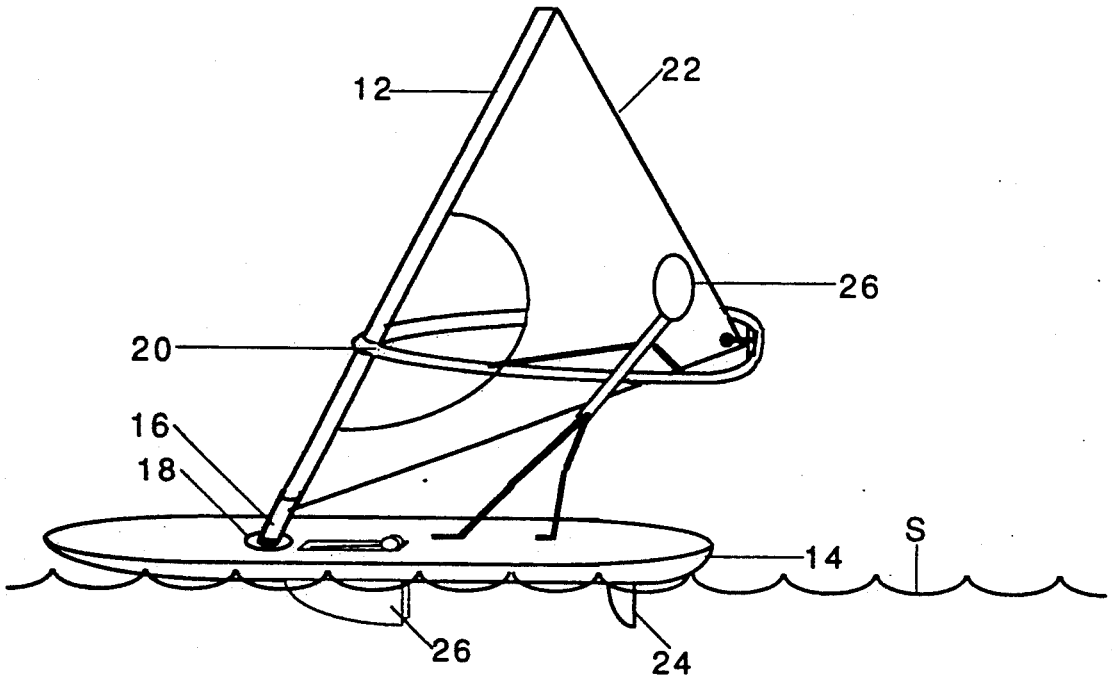
Figure 3 Prior Art
FIG. 3 is a perspective representation of a conventional sailboard.

FIG. 8(*b*) shows the hydrofoil wing 66 in an altered angle of attack position. The lifting force derived by the shape of the hydrofoil wing 66 may add additional launching force. Also, the use of the hydrofoil wing 66 may alleviated the need for the center board 26, shown in FIG. 3, in conditions where one might otherwise be desired. The FIG. 8(*a*) and 8(*b*) embodiment including the hydrofoil wing 66 may be combined with elements of the other embodiments to achieve a desired configuration. For example, the location of the support post's 68 connection with the sailboard hull 14 may be varied, a coil spring or a gas spring may assist or replace the user supplied force and may act as a shock absorber to absorb the concussion of the sailboard's landing, etc.

Figure 9A:
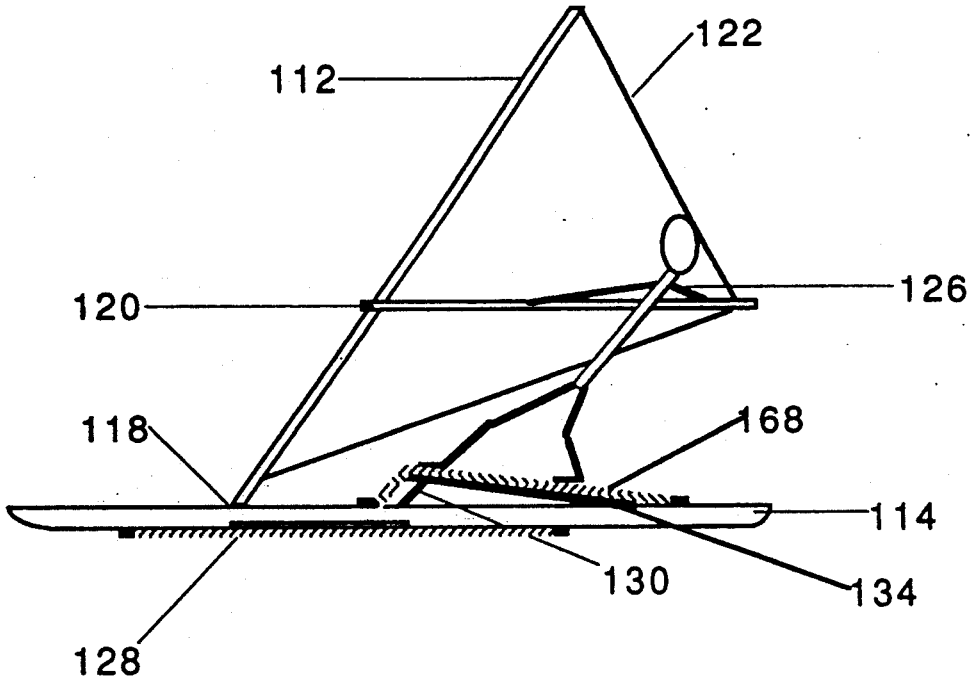
FIG. 9(*a*) is a perspective representation of yet another embodiment of the inventive device.
Figure 9B:
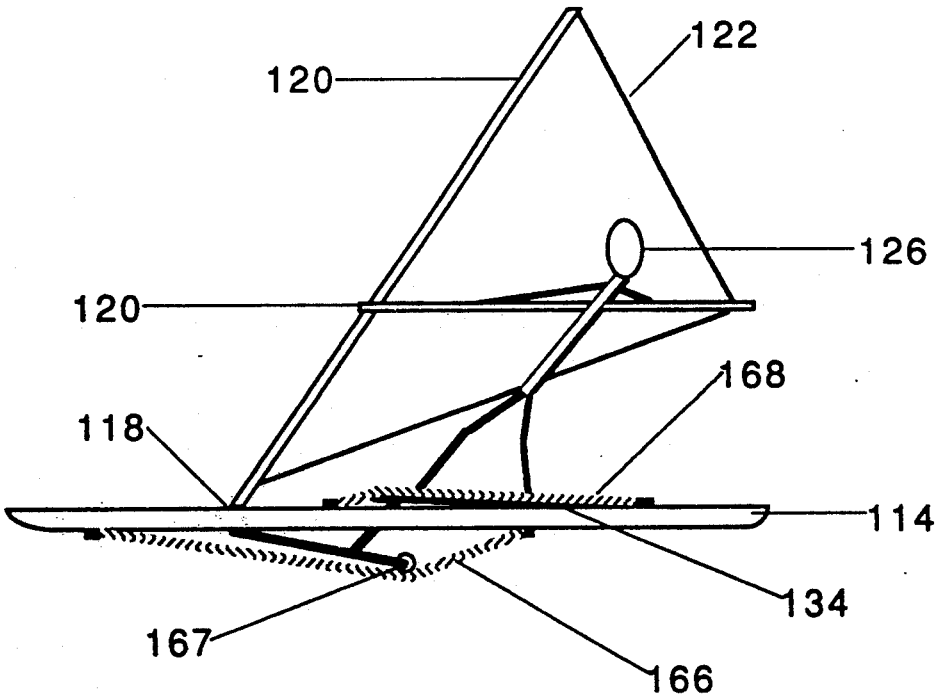

Referring to FIGS. 9(*a*) and 9(*b*), yet another embodiment of the inventive device is shown. In this embodiment, at least a portion of the bottom of the sailboard hull 114 is covered with an elastic sheet 166. This elastic sheet 166 acts to promote streamlining of the bottom of the sailboard hull 114. Also, the elastic sheet 166 acts to urge the flap 128 upwards. As shown in FIG. 9(*a*), the footboard 143 may be covered with an elastic sheet 168. The elastic sheet 168 tends to urge the flap 128 downward and also provides a non-skid surface for the user 126. As shown in FIG. 9(*b*), when the user 126 forces the flap 128 down, the elastic sheet 166 deforms so that the sailboard is launched from the water. A roller member 167 insures that the flap 128 has a smooth motion as it deforms the elastic sheet 166.

Figure 10A:
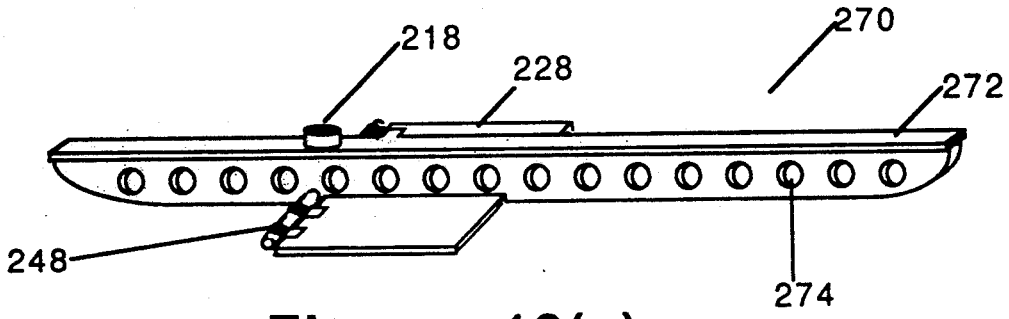
FIG. 10(*a*) is a perspective representation of an embodiment of a structural frame of the inventive device.
Figure 10B:
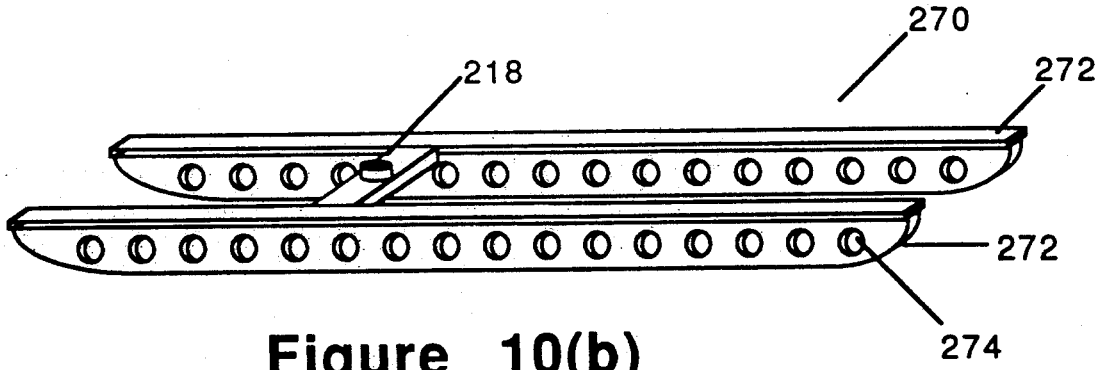

Referring to FIGS. 10(*a*) and 10(*b*), an embodiment of a structural frame 270 of the inventive device is shown. The structural frame 270 includes at least one spar 272 which may be made from aluminum, wood, plastic, composite material, etc. Each spar 272 may have holes 274 which act to reduce weight without substantially affecting the strength of the spar 272. The flap 228 is pivotally supported by the spar 272 by the hinges 248. Preferably, the mast hole 218 is positioned on the spar 272 above the pivoting point of the flap 248. FIG. 10(*b*) shows an embodiment in which the structural frame 270 includes two spars 272. It is noted that a flap does not necessarily have to be included. The structural frame 270 supports the body of the sailboard hull (not shown) which may be a foamed plastic, wood or sheet metal skin.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

I claim:

1. An apparatus for launching a sailboard and user having a combined momentum while sailing on a body of water, comprising:

at least one flap submergible in the water, pivotally supported by the sailboard and having an initial angle of attack relative to the water and relatively parallel with a longitudinal axis of the sailboard; and positioning means operable by the user while sailing for selectably extending the flap to an operable angle of attack relative to the water and relatively oblique with the longitudinal axis of the sailboard to position the flap effective to convert a least a portion of the momentum into a lifting force effective to launch at least a portion of the sailboard out of the water during the movement of the flap to the extended position.

2. An apparatus for launching a sailboard according to claim 1, wherein the positioning means includes a stem member connected to the flap and operable by a user whereby a user exerted force is transferred through the stem member to vary the angle of attack of the flap.

3. An apparatus for launching a sailboard according to claim 2, further comprising a footboard member positioned near the top and connected to the stem member for transferring a force from the user through the stem to the flap effective to cause the flap to pivot from the initial angle of attack to the operable angle of attack; and an elastic sheet member disposed on a top portion of the sailboard over at least the footboard member and effective to deform when the angle of attack of the flap is varied.

4. An apparatus for launching a sailboard according to claim 1, wherein the positioning means includes force storage means selectably operable by the user and in operable contact with the flap and comprising at least one of a coil spring and a gas spring for temporarily storing a force effective to vary the angle of attack of the flap from the initial angle of attack to the operable angle of attack.

5. An apparatus for launching a sailboard according to claim 4, wherein the force is stored in the gas spring by an air pump.

6. An apparatus for launching a sailboard according to claim 3, wherein the force is stored in the gas spring by a compressed gas cylinder.

7. An apparatus for launching a sailboard according to claim 1, further comprising an elastic sheet member disposed on the bottom of the sailboard over at least the flap and effective to deform when the angle of attack of the flap is varied.

8. An apparatus for launching a sailboard and a user having a combined momentum while sailing on a body of water, said sailboard having a mast hole, a bow, a center, a top and a bottom, comprising: h a flap positioned towards the bottom and having an end pivotally supported by the sailboard at an initial angle of attack relative to the water and relatively parallel with a longitudinal axis of the sailboard;

positioning means operatively connected to the flap and operable by the user while sailing for selectably applying a force on the flap to cause the flap to pivot and extend to an operable angle of attack relative to the water and relatively oblique with the longitudinal axis of the sailboard to dispose the flap at a position effective to convert part of the momentum into a lifting force effective to launch at least a portion of the sailboard out of the water during the movement of the flap to the extended position.

9. An apparatus for launching a sailboard according to claim 8, wherein the flap is pivotally supported at the end at a point between the bow and the center so as to be effective to generate a center of rotation at the point effective to lift at least the bow out of the water when the flap pivots to the operable angle of attack.

10. An apparatus for launching a sailboard according to claim 8, wherein the flap is pivotally supported at the end at a point directly below the mast hole to effectively transfer a portion of the lifting force through a mast of the sailboard.

11. An apparatus for launching a sailboard according to claim 8, further comprising force storage means selectably operable by the user and in operable contact with the flap and comprising at least one of a coil spring and a gas spring for temporarily storing a force effective to vary the angle of attack of the flap from the initial angle of attack to the operable angle of attack.

12. An apparatus for launching a sailboard according to claim 8, further comprising an elastic sheet member disposed on the bottom of the sailboard over at least the flap and effective to deform when the angle of attack of the flap is varied.

13. An apparatus for launching a sailboard according to claim 8, wherein the positioning means includes a footboard member positioned near the top for transferring a force from a user to the flap to cause the flap to pivot from the initial angle of attack to the operable angle of attack; and further comprising an elastic sheet member disposed on a top portion of the sailboard over at least the footboard member and effective to deform when the angle of attack of the flap is varied.

14. An apparatus for lifting a sailboard and a user having a combined momentum while sailing on a body of water, comprising:

hydrofoil wing means for providing a lifting force to the sailboard as the sailboard is being sailed on the body of water;

supporting means for supporting the hydrofoil wing means and connected to the sailboard; pivotal connecting means for pivotally connecting the hydrofoil wing means to the supporting means: and positioning means operable by the user while sailing for selectably extending the hydrofoil wing means from an initial angle of attack relative to the water to an operable angle of attack relative to the water and relatively oblique with the longitudinal axis of the sailboard to position the hydrofoil wing means effective to convert at least a portion of the momentum into a lifting force effective to launch at least a portion of the sailboard out of the water during the movement of the hydrofoil wing means to the extended position.

15. An apparatus for lifting a sailboard according to claim 14, further comprising means for temporarily fixing a position of the position means.

16. An apparatus for lifting a sailboard according to claim 14, further comprising spring means for applying a spring force to the hydrofoil wing means and operable to alter the angle of attack.

17. An apparatus for launching a sailboard according to claim 14, wherein the positioning means includes force storage means selectably operably by the user and in operable contact with the hydrofoil wing means and comprising at least one of a coil spring and a gas spring for temporarily storing a force effective to vary the angle of attack of the hydrofoil wing means from the initial angle of attack to the operable angle of attack.

18. An apparatus for launching a sailboard according to claim 14, wherein the positioning means includes a stem member connected to the hydrofoil wing means and operable by a user whereby a user exerted force is transferred through the stem member to vary the angle of attack of the hydrofoil wing means and a footboard member positioned near the top and connected to the stem member for transferring a force from the user through the stem to the hydrofoil wing means effective to cause the hydrofoil wing means to pivot from the initial angle of attack to the operable angle of attack; and an elastic sheet member disposed on a top portion of the sailboard over at least the footboard member and effective to deform when the angle of attack of the hydrofoil wing means is varied. e

* * * * *